US005832097A

United States Patent [19]

Armstrong et al.

[11] Patent Number: 5,832,097

[45] Date of Patent: Nov. 3, 1998

[54] MULTI-CHANNEL SYNCHRONOUS COMPANDING SYSTEM

[75] Inventors: Stephen W. Armstrong; Frederick E. Sykes, both of Burlington; Ronald J. D. Csermak, Hamilton, all of Canada

[73] Assignee: Gennum Corporation, Burlington, Canada

[21] Appl. No.: 530,049

[22] Filed: Sep. 19, 1995

[51] Int. Cl.[6] ..... H04R 25/00

[52] U.S. Cl. ..... 381/321; 381/312; 381/98; 381/106

[58] Field of Search ..... 381/68, 68.2, 68.4, 381/63, 29, 31, 34, 94, 98, 106

[56] References Cited

U.S. PATENT DOCUMENTS

| | | | |
|---|---|---|---|
| 4,099,035 | 7/1978 | Yanick | 381/68.2 |
| 4,396,806 | 8/1983 | Anderson | 179/107 |
| 4,759,071 | 7/1988 | Heide | 381/68.4 |
| 4,829,270 | 5/1989 | Anderson | 333/14 |

FOREIGN PATENT DOCUMENTS

| | | | |
|---|---|---|---|
| 0 481 528 A2 | 5/1987 | European Pat. Off. | H04R 25/00 |
| 2 566 658 | 6/1984 | France | A61F 11/04 |
| WO 85/02085 | 5/1985 | WIPO | H04R 25/00 |
| WO 89/08353 | 9/1989 | WIPO | H04B 1/64 |

*Primary Examiner*—Sinh Tran
*Attorney, Agent, or Firm*—Bereskin & Parr

[57] ABSTRACT

A multi-channel synchronous compander for hearing aids, in which the input signal from an input transducer is directed through a 2:1 front compressor, then through a band splitting filter to divide it into a desired number of frequency bands, then through expander/compressors to provide selected expansion/compression of each frequency band depending on the user's hearing impairment. The outputs of the expander/compressors are summed, amplified and directed to the hearing aid output transducer. The compressor and each expander/compressor are all controlled by control signals derived from the compressed signal level at the output of the front compressor. The use of common control signals for both the front end compression and the expansion removes the need for close matching of temporal performance and improves the output signal fidelity. The front compressor allows the filter capacitors to be reduced in size so that they can be integrated. Sounds above a high level threshold do not change the gain applied to input signal, even when changes are made in the expansion/compression ratios of the expander/compressors.

14 Claims, 8 Drawing Sheets

MULTI-CHANNEL SYNCHRONOUS COMPANDING SYSTEM

FIELD OF THE INVENTION

This invention relates to a synchronous companding system for audio amplifiers. The companding system of the invention is particularly suitable for use in hearing aids.

BACKGROUND OF THE INVENTION

Hearing impairment is often characterized by a loss of sensitivity to quiet or low level sounds. The loss of sensitivity can either be frequency dependent or it can be across the entire frequency spectrum of the affected individual's hearing. It is more common for the threshold of hearing to display a frequency dependence, whereby the ear is not equally sensitive to sound pressure at various frequencies. This characteristic is observable for individuals with normal hearing as well as for those with a hearing impairment.

Another observed phenomenon in individuals with hearing loss is loudness growth. This means that although the threshold of hearing is elevated, there is not usually an equal elevation in the upper comfort level. Most hearing impaired individuals subjectively rate sounds as being loud at a sound pressure similar to that which their normal counterparts would also consider to be loud. Measurement of the subjective responses to gradually increasing sound levels between the two extremes of hearing threshold and hearing discomfort reveal that hearing impaired persons have an initially faster rise in perceived loudness growth for sounds above threshold. At elevated sound pressures, the rate of growth tends to match that of persons with normal hearing.

The phenomena of loudness growth and frequency dependence of loss suggests that a signal level dependent gain and frequency response shape would appropriately compensate for hearing impairment. The overall goal would be to provide the most gain in quiet to the frequencies of most loss and gradually adapt the response shape to a flat unity gain in loud environments where amplification is not required, since hearing has returned to normal. Various attempts have been made in the past to provide a suitable gain response shape taking these factors into account. However while some success has been achieved, improvement is needed.

BRIEF SUMMARY OF THE INVENTION

It is therefore an object of the present invention, in one of its aspects, to provide an improved companding system suitable for use in audio amplifiers; and which are particularly suitable for hearing aids. In one aspect the invention provides an audio circuit comprising:

(a) input means for receiving an electrical audio input signal, (b) front compressor means coupled to said input means for compressing said input signal to produce a compressed signal, (c) filter means coupled to said front compressor means for receiving said compressed signal and for dividing said compressed signal into at least two frequency band signals, each in a different frequency band, said filter means having at least first and second outputs, one for each frequency band signal, (d) at least first and second expander/compressor means, one coupled to each of said outputs of said filter means, each for selectively expanding or compressing one of said frequency band signals, and for producing output signals, (e) means for combining said output signals, (f) control signal generator means for producing first and second control signals each dependent on the level of said input signal, (g) means coupling said first control signal to said front compressor means and said second control signal to said expander/compressor, means, so that said front compressor means and each said expander/compressor means are all controlled by said control signal generating means.

Further objects and advantages of the invention will appear from the following description, taken together with the accompanying drawings.

DETAILED DESCRIPTION OF PREFERRED EMBODIMENTS

PRIOR ART (FIG. 1)

Figure 1:
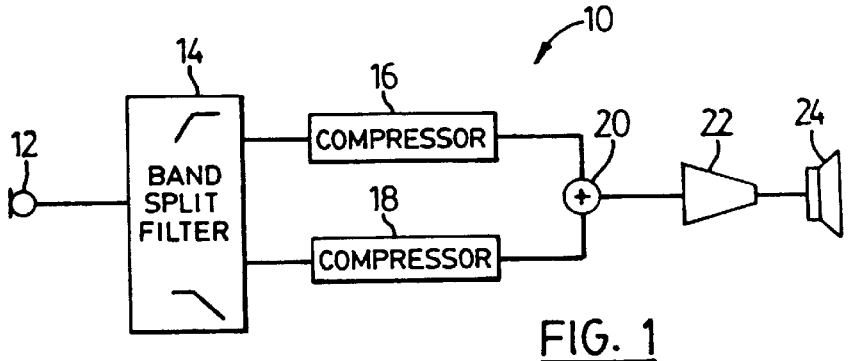
FIG. 1 (PRIOR ART)
FIG. 1 is a block diagram of a prior art multi-channel hearing aid.

Reference is first made to FIG. 1, which shows a conventional prior art hearing aid compression circuit 10 using multi-channel compression. In the circuit 10, the incoming signal from the microphone 12 is split into two or more frequency bands by selective filtering in a filter 14. Each frequency band is independently processed by a compressor 16, 18. Each compressor may include an automatic gain control (AGC) amplifier (not shown) which may have a variable compression ratio and gain and threshold adjustments, so that when the processed signals are combined with each other at summer 20, the combination will produce a reasonable approximation to the inverse of the loudness growth characteristics of a particular hearing aid user. The summed output is amplified in amplifier 22, the output of which is connected to a transducer or speaker 24.

Independent compressors in each band require individual level detectors to generate the required control signals. The capacitors which are needed to smooth the level detector signals cannot easily be integrated on silicon and must therefore be formed as components external to the integrated circuitry. This results in physical capacitor volumes which are larger than is desirable for hearing aids (which are usually made as small as possible).

In addition, the band splitting filter 14 is preferably implemented as a State Variable filter which simultaneously yields both high pass and low pass outputs, but such filters require one capacitor for each 6 dB per octave of roll-off. This requires multiple capacitors in the filter. Because of the large dynamic range required for the filter, large values of capacitance are needed to minimize the noise of the circuit. These capacitors are also too large to be easily integrated, thereby consuming additional valuable physical volume external to the integrated circuit.

SYSTEM DESCRIPTION (FIGS. 2–4)

Figure 2:
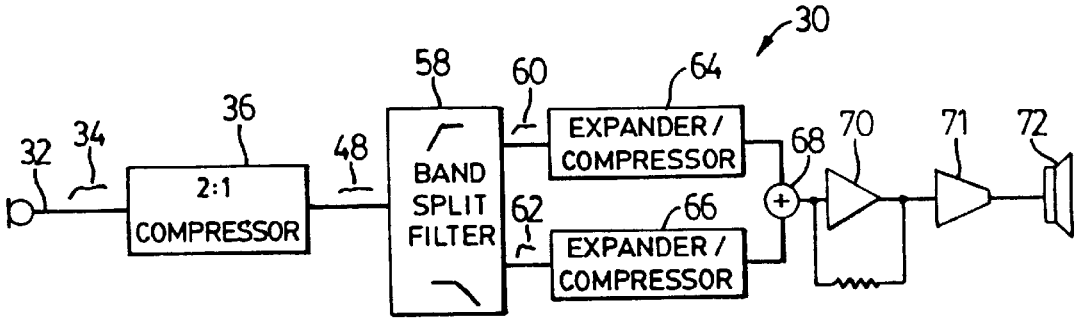
FIG. 2 is a block diagram of a multi-channel synchronous companding system according to the present invention, shown in very simple form.
Figure 3A:
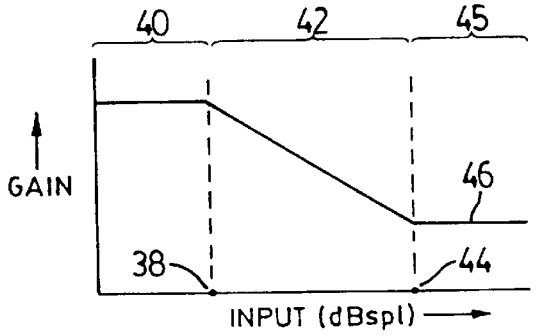
FIGS. 3A and 3B are graphs showing gain and output respectively versus input sound level for the front end compressor of FIG. 2.
Figure 3B:
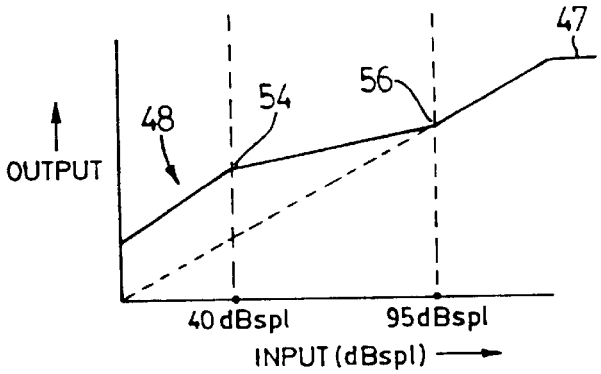

Reference is next made to FIG. 2, which shows in block diagram form a simplified view of a system 30 according to the invention. In FIG. 2 an input transducer 32, typically a microphone, supplies an input signal 34 to a front end compressor 36, typically a 2:1 compressor. As shown in FIGS. 3A and 3B, compressor 36 applies constant maximum gain to quiet signals below a selected lower threshold 38, e.g. 40 dBspl, but reduces the gain to all signals above this threshold. Thus, as shown in FIG. 3A, the gain is constant in region 40 below 40 dBspl, and decreases in region 42 until a second and high level threshold 44 is reached, e.g. at 95 dBspl. Above the high level threshold 44, in region 45, the gain is again held constant as indicated at 46, regardless of signal level (until an upper output limit 47 is reached where the output amplifier 70 clamps or the microphone 32 clips).

The output signal 48, shown in FIG. 3B, increases with a fixed slope in region 40 below 40 dBspl, at which point a lower inflection point 54 occurs. From point 54, the output increases with a lower slope in region 42 (between 40 and 95 dBspl) and increases again with a higher slope in region 45 above 95 dBspl. The point 56 between regions 42, 45 in the input/output curve is referred to as an upper inflection point.

The output signal 48 from the compressor 36 is fed to a band split filter 58, typically a State Variable filter, which divides signal 48 into two (or if desired more than two) frequency bands or signals 60, 62. Each of these signals is fed through an individual expander/compressor 64, 66, the outputs of which are summed in summer 68 and fed through a gain amplifier 70 and a buffer amplifier 71 to an output transducer such as speaker 72.

The front end compressor 36 has the effect of reducing the dynamic range of signals which the filter 58 must process. This has the advantage of allowing smaller capacitors to be used in the filter, as will be explained, thus allowing the entire filter including its capacitors to be integrated onto silicon. The dynamic range is recovered (where desired) by the expander/compressors 64, 66.

Figure 4:
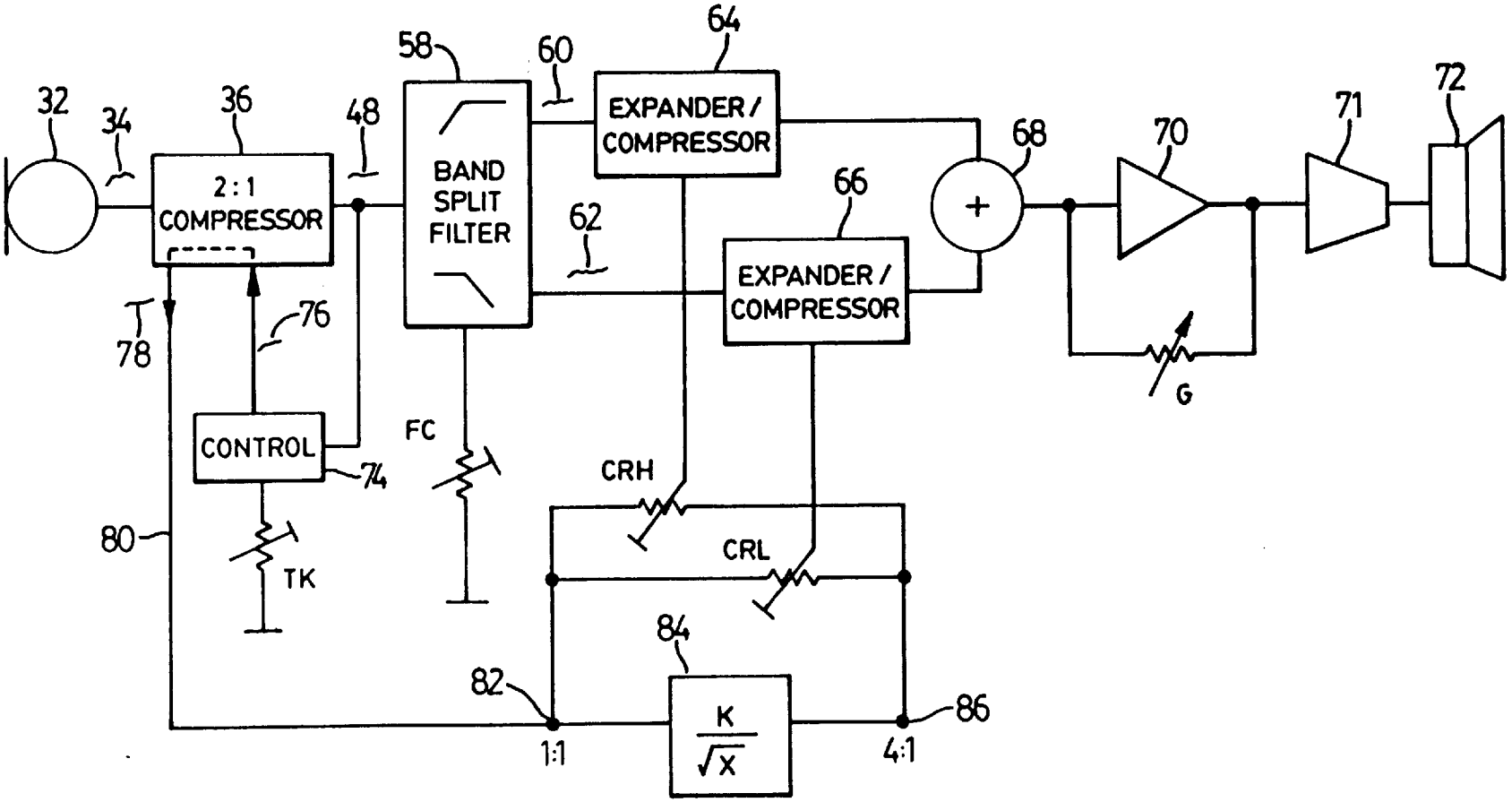
FIG. 4 is a block diagram showing the circuit of FIG. 2 with control blocks included.

An important feature of the FIG. 2 circuit is illustrated in FIG. 4, which is a more detailed view of the FIG. 2 circuit and in which corresponding reference numerals indicate corresponding parts. As shown in FIG. 4, front compressor 36 has a feedback topology, in that the level of its output signal 48 is detected and fed back to a control circuit 74 which produces a first control signal 76. Not only is the control signal 76 used to control the front compressor 36, but also a second control signal 78 derived from signal 76,is used to control each expander/compressor 64, 66, via lead 80. As will be explained in more detail below, the lead 80 is connected to one terminal 82 of a block 84 (which is labelled $$\frac{K}{\sqrt{X}}$$

for reasons which will be explained). The block 84 produces at its second terminal 86 a signal which is a modified form of the second control signal 78. The signals at each terminal of block 84 are scaled by variable resistors CRH and CRL and applied to each expander/compressor block 64, 66 as will be explained.

Control circuit 74 is adjusted by variable resistor TK, which serves as a threshold control to adjust the maximum gain provided by compressor 36 for low level signals and for signals above the inflection point 56. Band split filter 58 is controlled by a variable resistor FC which adjusts the crossover frequency of the filter, as is well known.

The summer 68 is typically simply an operational amplifier using a resistive summing network.

The combination of compression and expansion shown in FIGS. 2 and 4 is referred to as companding, and permits recovery of the full dynamic range of the input signal, even though a filter 58 of significantly less dynamic range is in the signal path. Companding is also used in other applications, such as portable phones, and in noise reduction circuitry for analog tape recordings. However in both these cases, independently operating compression and expansion circuits are used, each with individual level detection circuits, one for compression and one for expansion. The independent level detectors used require additional components, but more importantly they require close matching of temporal performance if accurate recovery of the original signal envelope is to be used. With the circuit shown in FIG. 4, the same level detector signal that is responsible for front end compression in front compressor 36 is also used to control the expansion after the filter 58. This eliminates the need for good matching for temporal performance and improves the fidelity of the final audio signal. The use of the same level detector signal to control both the front end compressor and the expander(s) may be referred to as "synchronous companding".

COMPRESSOR AND CONTROL CIRCUIT DESCRIPTION (FIG. 5)

Figure 5:
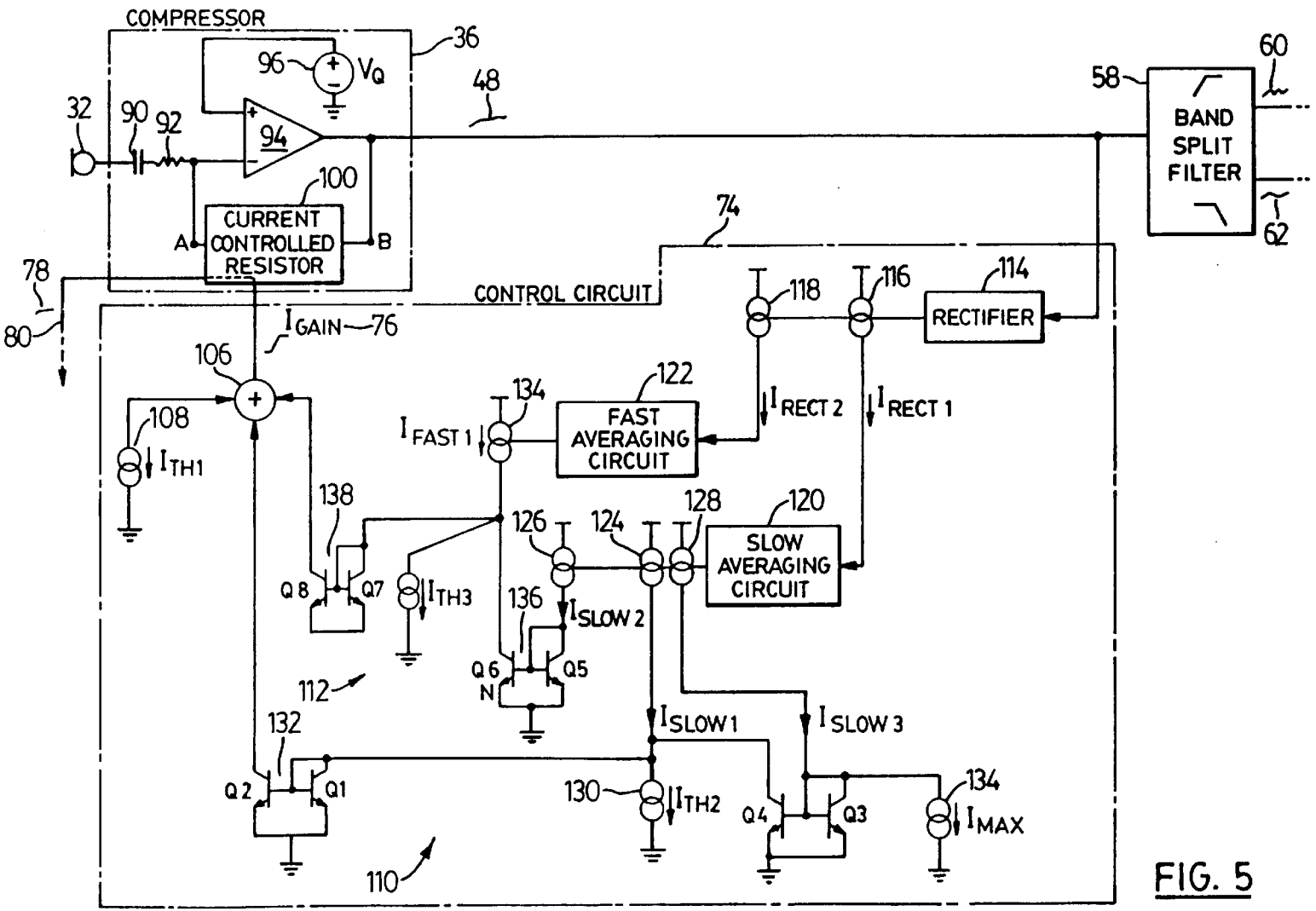
FIG. 5 is a block diagram of a typical front end compressor and control circuit which may be used with the circuit of FIGS. 2 and 4.

A circuit which may be used for implementing the compressor 36 of FIGS. 2 and 4 is shown in FIG. 5. The circuit of FIG. 5 is largely the same as that shown in my copending published Canadian patent application serial no. 2,090,531 filed Feb. 26, 1993 and entitled "Dual Time Constant Audio Compression System", and in my corresponding U.S. patent application Ser. No. 08/024,594 filed Mar. 1, 1993 under the same title (and which has an identical disclosure). The description and drawings of both said prior applications are hereby incorporated by reference into this application in their entirety.

As shown in FIG. 5, the microphone 32 is connected through a coupling capacitor 90 and an input resistor 92 to the inverting input of an operational amplifier 94 which forms part of the compressor 36. The non-inverting input is connected to a reference voltage source 96.

Amplifier 94 is connected in a negative feedback mode, with its output connected through a current controlled resistor (CCR) 100 to its inverting input. The resistance value of the CCR 100 is a function of the first control signal 76, which as shown in FIG. 5 is a gain control current $I_{GAIN}$.

The gain control current $I_{GAIN}$ is fed to the CCR 100 by the control circuit 74. Control circuit 74 includes a current summer 106 having three inputs and an output. The first input is connected to a threshold current reference 108; the second input is connected to a first variable current reference 110, and the third input is connected to a second variable current reference 112.

The threshold current reference 108 produces a reference current $I_{TH1}$ and comprises a current sink which in known manner sinks the current $I_{TH1}$. The constant gain of amplifier 94 is achieved using current reference $I_{TH1}$ and is made a function of the magnitude of current $I_{TH1}$ by designing the first variable current reference 110 and the second variable current reference 112 to be zero below the first loudness threshold level 38, e.g. 40dBspl.

The control circuit 74 also includes a rectifier circuit 114, and first and second current sources 116, 118 connected to the output of rectifier 114. The current sources 116, 118 which are (as explained in said prior applications) voltage controlled current sources, produce first and second equal output currents $I_{RECT1}$ and $I_{RECT2}$, whose instantaneous values are proportional to the rectified instantaneous voltage level of the compressor output signal 48.

A slow averaging circuit 120 and a fast averaging circuit 122 are used to generate control signals which affect $I_{GAIN}$ in the ranges desired. The slow averaging circuit 120 is the circuit which is usually in operation and as described in said prior applications, achieves averaging operation by feeding the current $I_{RECT1}$ into the combination of a capacitor, resistor and operational amplifier (not shown) to produce a current representative of the average of current $I_{RECT1}$. This current is sensed using known techniques and is replicated by three current sources 124, 126, 128 which produce identical averaging output currents $I_{SLOW1}$, $I_{SLOW2}$, and $I_{SLOW3}$.

The averaging output current $I_{SLOW1}$ is compared to a second threshold current $I_{TH2}$ which is produced by a current source 130 in the first variable current reference 110. The current source 130 is coupled to a current mirror 132 formed from transistors $Q_1$, $Q_2$. The difference between the averaging current $I_{SLOW1}$ and the threshold current $I_{TH1}$ is produced or mirrored at the collector of transistor $Q_2$ and forms the output of current mirror 132.

If the averaging current $I_{SLOW1}$ is less than the threshold current $I_{TH2}$, then transistor $Q_1$ will not conduct so there will be no collector current in transistor $Q_2$. The CCR 100 will continue to be controlled by current $I_{TH1}$ and the gain will be in region 40 of FIG. 3.

As averaging current $I_{SLOW1}$ increases in response to an increasing input signal 32, i.e. increased loudness, it will eventually exceed the value of current $I_{TH2}$. The difference in currents will be mirrored as the collector current of transistor $Q_2$, which will then be added to the threshold current $I_{TH1}$ by the current summer 106. This increases the gain control current $I_{GAIN}$ to reduce the resistance value of CCR 100, producing a compression ratio which may in the example illustrated be 2:1.

As shown in FIG. 3A, after the input signal 34 goes above the high level threshold 44, the gain of compressor 36 is to become constant again. This is accomplished by the combination of current $I_{SLOW3}$, current source 134 which produces current $I_{MAX}$, and transistors $Q_3$ and $Q_4$. When $I_{SLOW3}$ is less than $I_{MAX}$, transistors $Q_3$ and $Q_4$ do not conduct and therefore have no effect on transistors $Q_1$, $Q_2$. However when $I_{SLOW3}$ becomes larger than $I_{MAX}$, the difference current flows into $Q_3$ and is mirrored by $Q_4$ into the collector of $Q_1$. Thus the current into $Q_1$ is:

$$I_{SLOW1}-I_{TH2}-(I_{SLOW3}-I_{MAX})$$

and since $I_{SLOW1}=I_{SLOW3}$, therefore the current into $Q_1$ is:

$$I_{MAX}-I_{TH2}.$$

Since both $I_{MAX}$ and $I_{TH2}$ are constants, this means that the current into summer 106 is now constant, and therefore the gain of the compressor becomes constant again, as shown at 46 in FIG. 3A (of course at a lower level than before compression).

The fast averaging circuit 122 is the same as the slow averaging circuit 120 except that its time constants are shorter (it deals with transient sounds), and it produces an averaging output current $I_{FAST1}$ at current source 134. Current $I_{FAST1}$ is compared to current $I_{SLOW2}$ through a current mirror 136 formed from two transistors $Q_5$, $Q_6$. By choosing the emitter area ratios of transistor $Q_5$ to transistor $Q_6$ as 1:N, the dynamic threshold can be set to determine the amount that the fast averaging current $I_{FAST1}$ must exceed the slower moving averaging current $I_{SLOW2}$ to assume gain control of the amplifier 94.

The difference between the fast averaging current $I_{FAST}$ and the scaled slow averaging current $I_{SLOW2}$ is mirrored by a current mirror 138 which is formed from transistors $Q_7$ and $Q_8$. The difference current is reproduced or mirrored as the collector current of transistor $Q_8$ and provides the third input to the current summer 106.

Similar to the operation of the current mirror 132 formed from transistors $Q_1$ and $Q_2$, the current mirror 138 will produce zero output current at the collector of transistor $Q_8$ if fast averaging current $I_{FAST1}$ is less than the sum of N times the slow averaging current $I_{SLOW2}$ and $I_{TH3}$. If the fast averaging current $I_{FAST1}$ exceeds the sum of the scaled slow averaging current $I_{SLOW2}$ and $I_{TH3}$, the difference is reproduced as the collector current of transistor $Q_8$. $I_{TH3}$ serves to prevent transients below threshold from causing short term compression. The current summer 106 adds the collector current of transistor $Q_8$ to the first threshold current $I_{TH1}$, again to reduce the gain of the amplifier 94.

Since fast averaging circuit 122 deals essentially with transient sounds, it is not essential to provide a clamp such as that provided by current source $I_{MAX}$, to prevent $I_{FAST1}$ from changing the gain above the loudness threshold, but this can be done if desired.

FILTER DESCRIPTION (FIG. 6)

Figure 6:
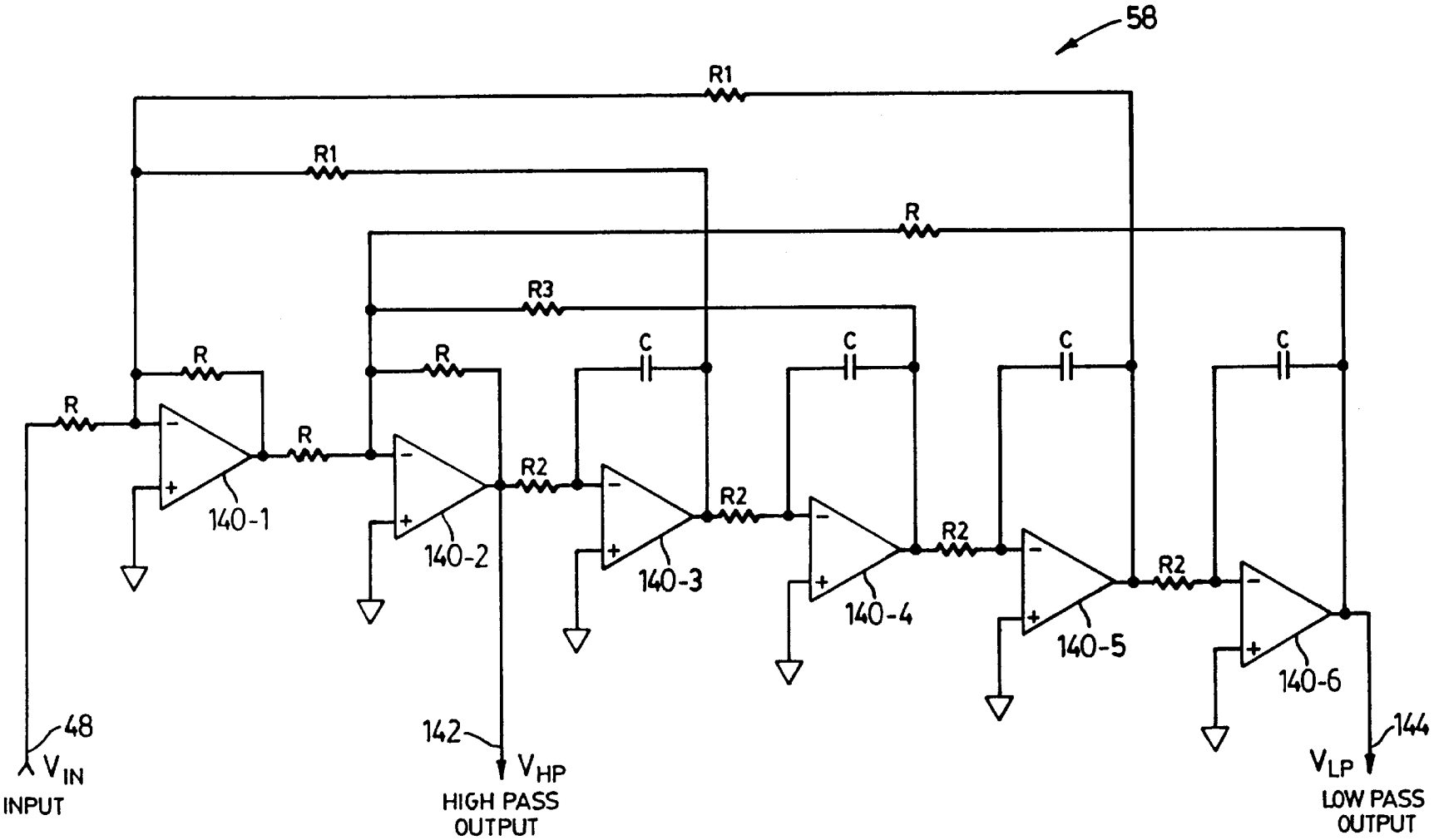
FIG. 6 (PRIOR ART)
FIG. 6 is a circuit diagram of a prior art band split filter which may be used with the circuit of FIGS. 2 and 4.

Reference is next made to FIG. 6, which shows an example of a typical State Variable filter which may be used as the filter 58 of FIGS. 2 and 4. Filter 58 is typically a fourth order Linkwitz-Riley filter and is well-known and will therefore be described only briefly.

Filter 58 includes a set of operational amplifiers 140-1 to 140-6 connected in series by resistors R and $R_2$ connected between the output of each amplifier and the inverting input of the following amplifier, and with feedback resistors R, $R_1$ and $R_3$. The output signal 48 from the compressor 36 is applied to the first resistor R. The high pass output signal 60 appears at 142 while the low pass output signal 61 appears at 144.

For a general state variable filter topology using inverting operational amplifiers, the low pass output $V_{LP}$ and the high pass output $V_{HP}$ are given by the following well known transfer functions:

$$\frac{V_{LP}}{V_{IN}} = \frac{1}{S^4 + \frac{R}{R_1} S^3 + \frac{R}{R_3} S^2 + \frac{R}{R_1} S + 1}$$

and $$\frac{V_{HP}}{V_{IN}} = \frac{S^4}{S^4 + \frac{R}{R_1} S^3 + \frac{R}{R_3} S^2 + \frac{R}{R_1} S + 1}$$

where S is the complex frequency (jω) of the input signal.

The transfer function for a Linkwitz-Riley fourth order filter (for the low pass output) is:

$$\frac{V_{LP}}{V_{IN}} = \frac{1}{S^4 + 2\sqrt{2}\, S^3 + 4S^2 + 2\sqrt{2}\, S + 1}$$

When the terms are matched, it will be seen that:

$$\frac{R}{R_1} = 2\sqrt{2}\text{, and } \frac{R}{R_3} = 4,$$

where $$f_c = \frac{1}{2\pi R_2 C} = \text{corner frequency.}$$

By way of example, if R=50 KOhms, $R_1$=17.5 KOhms $R_3$=12.5 KOhms, and the corner frequency is 1.7 KHz, then typical values are C=500 pF and $R_2$=187 KOhms.

Although other values can be chosen, use of four 500 pF capacitors enables the entire filter to be integrated on silicon, resulting in significant space saving.

It will be realized that the corner frequencies can be made adjustable, e.g. by making the four $R_2$ resistors variable. For example they can be implemented as current controlled resistors as used for AGC amplifiers, or they can be implemented using JFETs to make voltage controlled resistors, as will be well understood by those skilled in the art.

This adjustability will assist a practitioner in the fitting of the hearing aid to the hearing characteristics of a hearing impaired user. The fitting procedure usually begins by setting the overall gain for comfort in loud environments (i.e. above the high level threshold or inflection point 46). Then the input levels of the test signals are reduced toward more typical values. The comer frequencies of the bands of interest are adjusted, and the compression ratios in both these bands are then adjusted to provide the necessary gain in a quiet environment.

CURRENT CONTROLLED RESISTOR (FIGS. 7,8)

Figure 7:
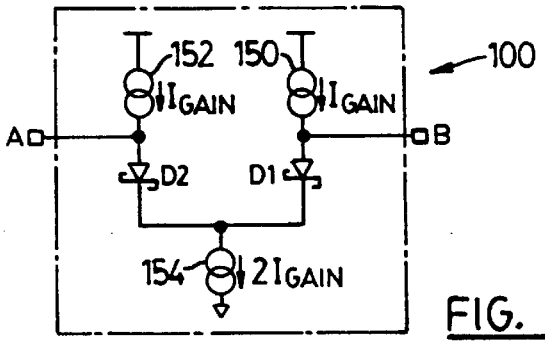
FIG. 7 is a block diagram of a portion of a current controlled resistor of FIG. 5.
Figure 8:
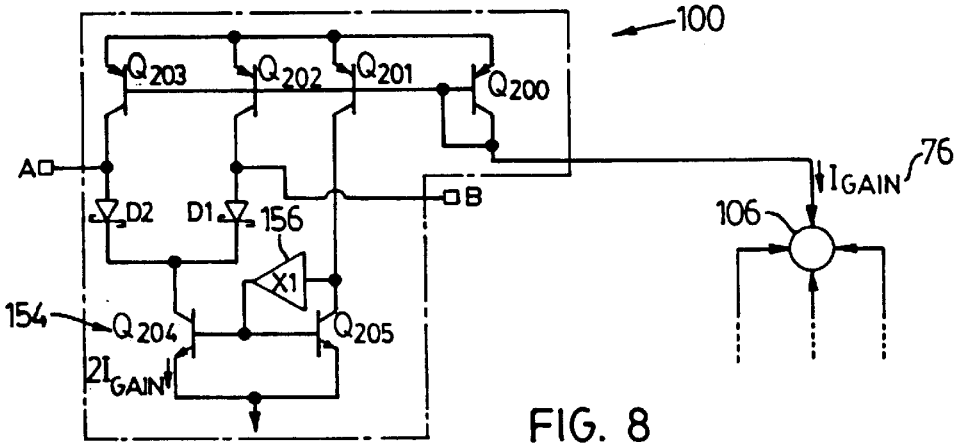
FIG. 8 is a circuit diagram of the current controlled resistor of FIG. 5.

Details of the CCR 100 are shown in FIGS. 7 and 8. FIG. 7 shows the equivalent resistance between nodes A and B of the CCR 100 in FIG. 5. As shown, the equivalent resistance between nodes A and B is produced by two current sources 150, 152, each of which produces current $I_{GAIN}$ and directs that current through two Schottky diodes $D_1$, $D_2$ and into a current sink 154. The equivalent resistance is the small signal impedance of diodes $D_1$, $D_2$ operating with current $I_{GAIN}$ and is:

$$R_{EQ} = \frac{2V_T}{I_{GAIN}}$$

where $V_T$ is the thermal voltage for a bipolar transistor junction and is about 26 millivolts at room temperature.

$$\text{Therefore } R_{EQ} = \frac{52\text{ mV}}{I_{GAIN}}.$$

FIG. 8 is a detailed transistor level implementation of the CCR 100, where the current sources and sink 150, 152, 154 have been implemented with traditional current mirror topology. As shown in FIG. 8, $Q_{200}$, $Q_{201}$, $Q_{202}$ and $Q_{203}$ are identical in construction and their bases and emitters are all tied together. Therefore their collector currents are all identical. Transistor $Q_{200}$ is diode connected to form a reference transistor whose collector current is forced to the desired value, namely $I_{GAIN}$ (since its collector is connected to summer 106). Transistor $Q_{205}$, and transistor $Q_{204}$ whose emitter area is twice that of $Q_{205}$, along with the unity gain buffer 156, form the current sink 154 in FIG. 7.

EXPANDER/COMPRESSORS (FIG. 9)

Figure 9:
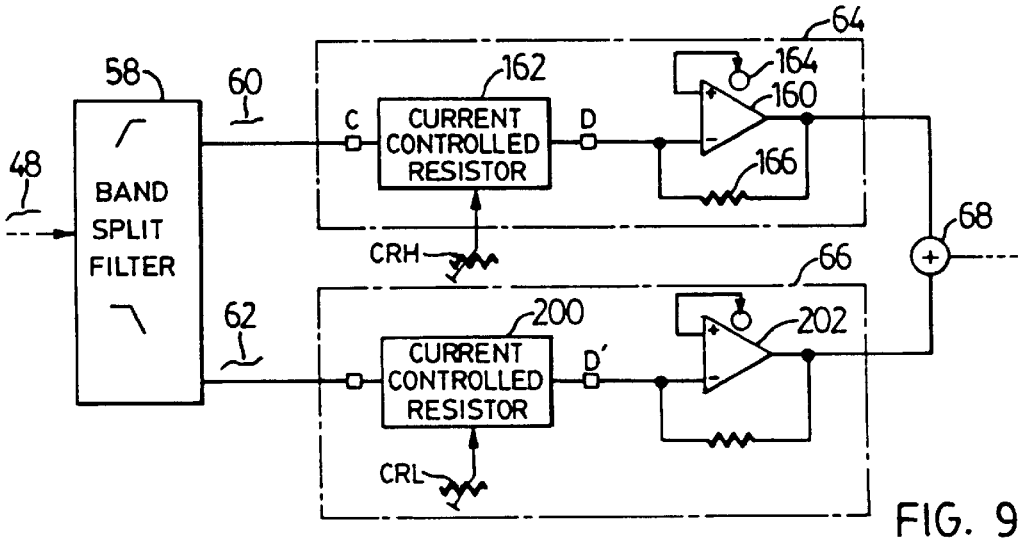
FIG. 9 is a block diagram showing details of the expander/compressors of FIGS. 2 and 4.

Reference is next made to FIG. 9, which shows the expander/compressors 64, 66. These are identical and only one will be described. As shown, expander/compressor 64 includes an operational amplifier 160 having its inverting input connected to one output of filter 58 through a series connected CCR 162. CCR is the same as CCR 100 and its resistance between nodes C and D will therefore vary as controlled by the control current applied to CCR 162 by resistor CRH.

A reference voltage source 164 is connected to the non-inverting input of amplifier 160, and resistor 166 provides negative feedback.

When the resistance of CCR 162 is lowered, by increasing the control current from resistor CRH, and since CCR 162 acts as an input resistor for amplifier 160, the gain of amplifier 160 will increase. This provides an expansion function, as will be explained. If control current into CCR 162 is reduced, the gain of amplifier 162 will decrease. This will provide further compression, as will also be explained.

K/√X BLOCK (FIGS. 10, 11)

Figure 10:
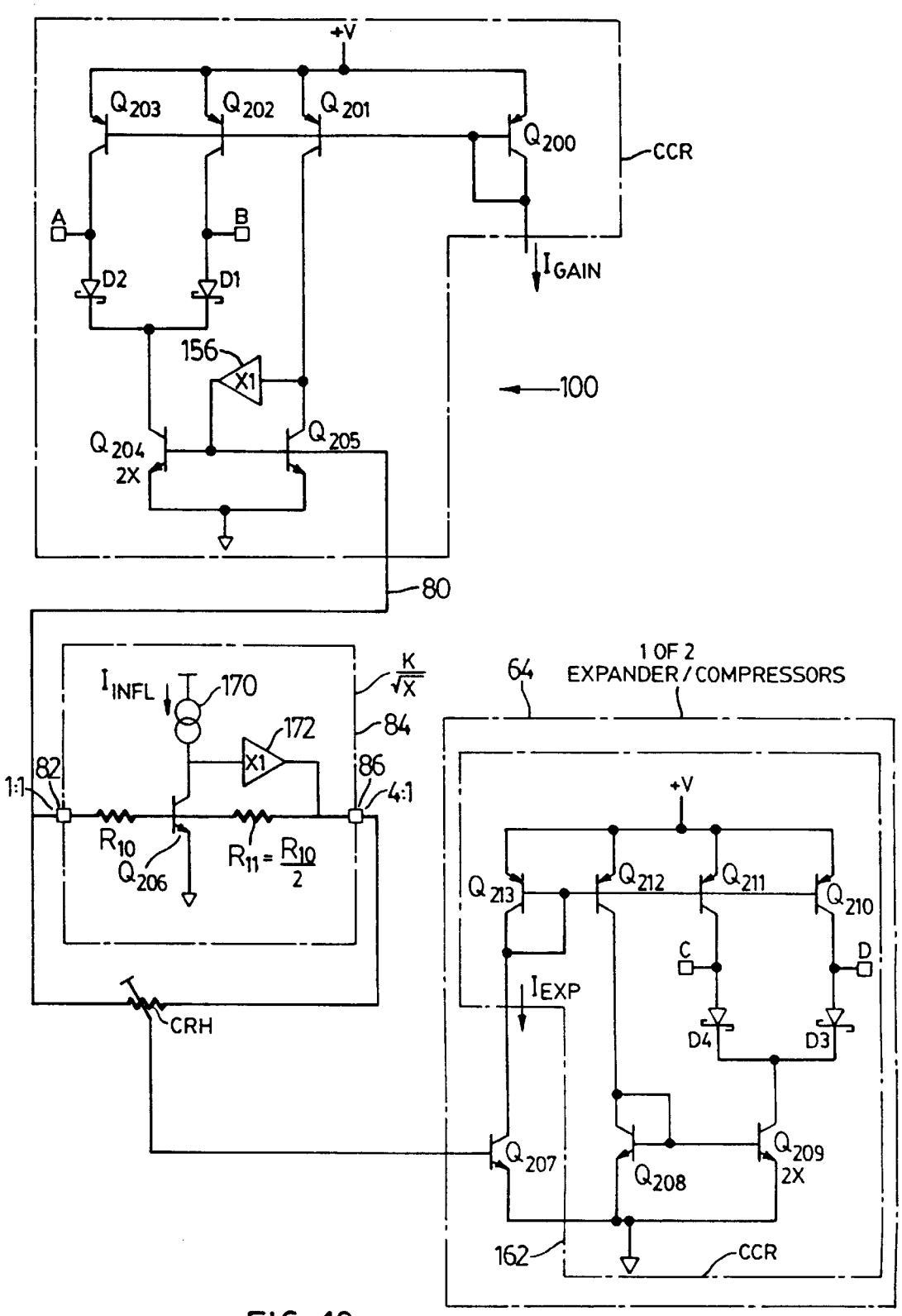
FIG. 10 is a circuit diagram showing the current controlled resistor of FIG. 7, together with portions of one of the control blocks and part of one of the expander/compressors of FIG. 4.

Reference is next made to FIG. 10, which reproduces the current controlled resistor 100 of FIG. 8 and shows two additional blocks, namely the $$\frac{K}{\sqrt{X}}$$

block 84, and part of the expander/compressor 64. As shown in FIG. 10, the base of transistor $Q_{205}$ is connected to terminal 82 of $$\frac{K}{\sqrt{X}}$$

block 84. Terminal 82 will also be called the 1:1 terminal, for reasons
which will become apparent.

As shown, block 84 is quite simple and has an input resistor $R_{10}$ connected to the base of transistor $Q_{206}$, the collector of which is supplied by an inflection current $I_{INFL}$ by current source 170. A unity gain buffer amplifier 172 is connected between the base and collector of transistor $Q_{206}$ through a resistor $R_{11}$ (where $R_{11}$=$R_{10}$/2). The node between the output of amplifier 172 and resistor $R_{11}$ is terminal 86 and will also be called the 4:1 terminal, as will be explained.

Variable resistor CRH is connected across the 1:1 and 4:1 terminals 82, 86, with the wiper of the resistor being connected to the CCR 162 of the expander/compressor 64. The voltage from CRH applied to the base of $Q_{207}$ controls the collector current $I_{EXP}$ (short for expanding current, as will be explained), forcing the collector currents of transistors $Q_{210}$, $Q_{211}$ and $Q_{212}$ also each to equal $I_{EXP}$. This produces an equivalent resistance across terminals C and D, the resistance being $$\frac{2V_T}{I_{EXP}} \text{ or } \frac{52\text{ mV}}{I_{EXP}}$$

as before.

The operation of $$\frac{K}{\sqrt{X}}$$

block 84 relies on the exponential logarithmic behaviour inherent in a bipolar transistor. The classic equation for a bipolar transistor conducting in a negative feedback loop with a unity gain buffer is:

$$V_{be} = V_T \ln \frac{I_C}{I_S} \text{ or } I_C = I_S e^{\frac{V_{be}}{V_T}}$$

where $V_{be}$ is the base-emitter voltage of the transistor, $V_T$ is as before the thermal voltage between the base and emitter (and is typically about 26 mV at room temperature), $I_C$ is the collector current of the transistor, $I_s$ is a fixed parameter related to the emitter area of the transistor.

Figure 11:
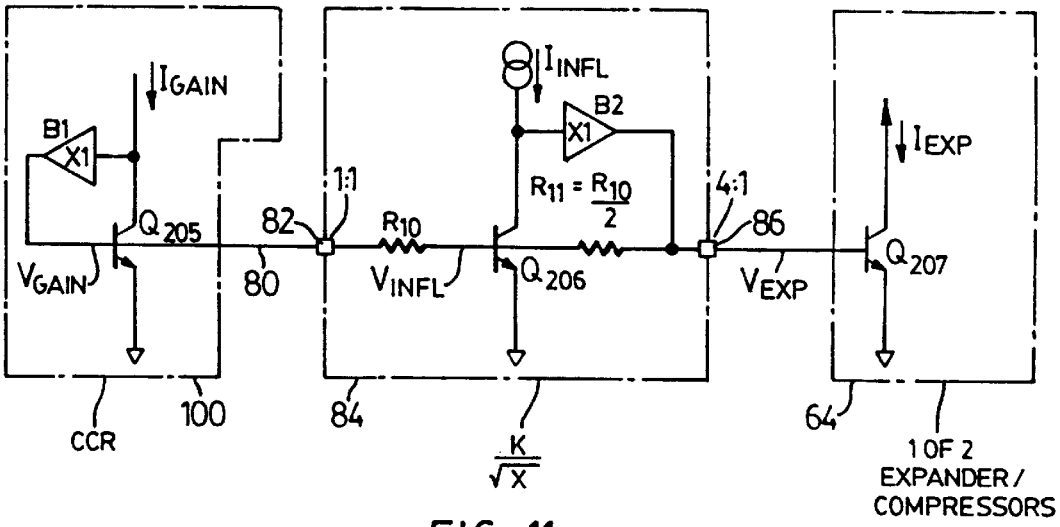
FIG. 11 is a diagram showing portions of the current controlled resistor, control block, and expander/compressors of FIG. 10.

With reference to FIG. 11, and beginning at the left side of that drawing, current $I_{GAIN}$ flows in the collector of transistor $Q_{205}$ (as shown in FIG. 10), resulting in $V_{GAIN}$ across the transistor, where $$V_{GAIN} = V_T \ln \frac{I_{GAIN}}{I_{S1}} .$$

(The notation $I_{S1}$, $I_{S2}$, $I_{S3}$ will be used for the $I_S$ parameters of $Q_{205}$, $Q_{206}$, $Q_{207}$ respectively.)

Similarly the current $I_{INFL}$ flowing in the collector of transistor $Q_{206}$ results in a voltage $V_{INFL}$ where $$V_{INFL} = V_T \ln \frac{I_{INFL}}{I_{S2}} .$$

The resistors $R_{10}$ and $R_{11}$ set up an amplifier that acts to amplify the difference between $V_{GAIN}$ and $V_{INFL}$ (FIG. 11). Assuming that resistor CRH is set so that the base of $Q_{207}$ is connected to the 4:1 terminal 86, then the amplified difference, namely $V_{EXP}$, is applied to the base of transistor $Q_{207}$, producing a collector current $I_{EXP}$. As shown in FIG. 10, current $I_{EXP}$ is used to define the equivalent resistance between nodes C and D, i.e. the value of the current controlled resistor 162 for expander/compressor 64.

In more detail, the mathematical analysis is as follows.

$$\begin{aligned} V_{EXP} &= (V_{INFL} - V_{GAIN}) \frac{R_{11}}{R_{10}} + V_{INFL} \\ &= -\frac{R_{11}}{R_{10}} V_{GAIN} + \left(1 + \frac{R_{11}}{R_{10}}\right) V_{INFL} \end{aligned}$$

since $$V_{EXP} = V_T \ln \frac{I_{EXP}}{I_{S3}}$$

we may substitute $$V_T \ln \frac{I_{EXP}}{I_{S3}} = -\frac{R_{11}}{R_{10}} \left( V_T \ln \frac{I_{GAIN}}{I_{S2}} \right) + \left(1 + \frac{R_{11}}{R_{10}}\right) \left( V_T \ln \frac{I_{INFL}}{I_{S1}} \right)$$

Solving for $I_{EXP}$ yields:

$$\frac{I_{EXP}}{I_{S3}} = e^{-\frac{R_{11}}{R_{10}} \ln \frac{I_{GAIN}}{I_{S2}} + \left(1 + \frac{R_{11}}{R_{10}}\right) \ln \frac{I_{INFL}}{I_{S1}}}$$

$$I_{EXP} = \frac{(I_{INFL})^{\left(1 + \frac{R_{11}}{R_{10}}\right)}}{(I_{GAIN})^{\frac{R_{11}}{R_{10}}}} \text{ assuming } I_{S1} = I_{S2} = I_{S3}$$

$$\text{setting } R_{11} = \frac{R_{10}}{2} \text{ results in}$$

$$I_{EXP} = \frac{(I_{INFL})^{1\frac{1}{2}}}{(I_{GAIN})^{1\frac{1}{2}}} = \frac{K}{\sqrt{I_{GAIN}}}$$

since $I_{INFL}$ is a known and fixed current.

The above analysis shows that when transistor $Q_{207}$ has its base connected to the 4:1 node 86 of the $$\frac{K}{\sqrt{X}}$$

block 84 (i.e. when the wiper of variable resistor CRH is at the right side of the resistor), then the current $I_{EXP}$ (which sets the value of the CCR 162) will be proportional to the inverse of the square root of $I_{GAIN}$. This is the condition needed to achieve an overall 4:1 compression ratio. The square root is needed since that is equivalent to dividing a number expressed in decibels by 2.

In contrast, when transistor $Q_{207}$ has its base connected to the 1:1 node 82 of $$\frac{K}{\sqrt{X}}$$

block 84, then current $I_{EXP}$ will be equal simply to $I_{GAIN}$, resulting in an overall system 1:1 linear output. This will be explained with reference to FIGS. 12 and 13.

SYSTEM OPERATION (FIGS. 12–14)

Figure 12:
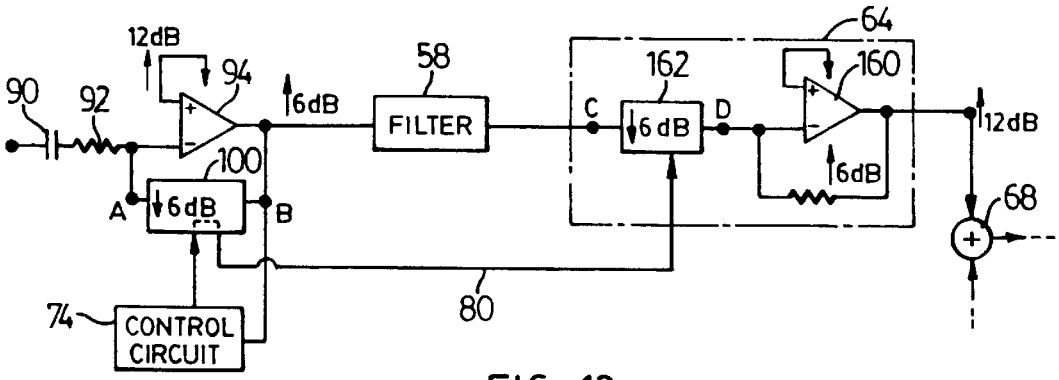
FIG. 12 is a block diagram showing the front end compressor and one compressor/expander of FIG. 4 and showing illustrative gains.
Figure 13:
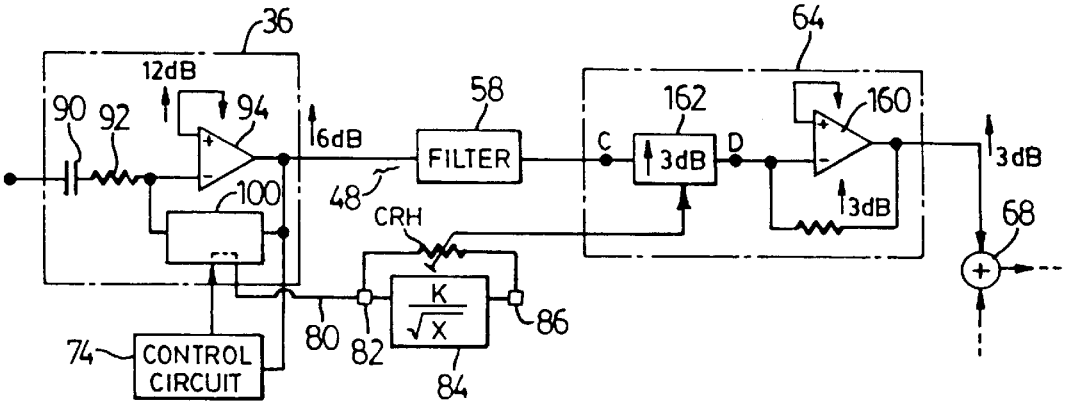
FIG. 13 is a block diagram showing the front end compressor and one compressor/expander of FIG. 4 and again showing illustrative gains.

FIGS. 12 and 13 are block diagrams showing the front end compressor 36, the filter 58, and one expander/compressor 64, to illustrate how the compression and expansion processes combined can together achieve an overall 1:1 or 4:1 compression ratio. In FIG. 12, which illustrates a 1:1 compression ratio, the $$\frac{K}{\sqrt{X}}$$

block 84 is not shown since it is not engaged (i.e. it is bypassed since the wiper of variable resistor CRH is at the left side of this resistor, at terminal 82, so that the base of transistor $Q_{205}$ is connected directly to the base of transistor $Q_{207}$).

In FIG. 12, assume that the output of amplifier 94 increases by 6 dB, as shown. Then the control circuit 74 will increase the current $I_{GAIN}$ to the CCR 100 (defined across nodes A–B as described) by 6 dB, resulting in a 6 dB decrease in the gain of the front compressor 36, implying that the input must have increased by 12 dB (therefore producing a 2:1 compression ratio).

The control circuit 74, by increasing $I_{GAIN}$ which flows in the collector of $Q_{205}$ and by causing a corresponding increase in $I_{EXP}$ at the collector of $Q_{207}$ (FIG. 10) also causes a 6 dB increase in the current flowing in the CCR 162 defined across nodes C–D. This results in a 6 dB reduction in the input resistance of compressor/expander 64. As indicated previously, decreasing the input resistance by 6 dB increases the gain of amplifier 160 by 6 dB.

The 6 dB increase of the signal level at the output of the front compressor 36, combined with the 6 dB increase in the gain of the expander compressor 64, yields a 12 dB increase in the output level at the summer 68. A 12 dB increase in output level divided by a 12 dB increase in signal level at the input gives a 1:1 compression ratio overall.

FIG. 13 illustrates the 4:1 compression ratio situation. In the front compressor 36, the same result occurs as in FIG. 12, i.e. a 12 dB input signal increase results in a 6 dB level increase in the front compressor output signal 48. However the signal at the base of $Q_{205}$ is applied to the $$\frac{K}{\sqrt{X}}$$

block 84, which changes the sign of the decibel increase and divides it by 2. Thus the 6 dB increase in $I_{GAIN}$ results in a 3 dB decrease in $I_{EXP}$, which results in a 3 dB increase in the equivalent resistance of the CCR 162 between nodes C and D. Therefore the gain of the expander/compressor 64 is decreased by 3 dB, resulting in an output at summer 68 which is increased by only 3 dB. Since this is only one-quarter of the 12dB increase at the input to front compressor 36, this yields an overall 4:1 compression ratio for the system.

As described, the wiper of resistor CRH may be used as the base connection of transistor $Q_{207}$. Then, by selecting an appropriate position for the wiper, any value of compression ratio between the extremes of 1:1 and 4:1 can be obtained.

As shown in FIGS. 4 and 9, resistor CRL is also a variable resistor connected across the $$\frac{K}{\sqrt{X}}$$

block 84, and its wiper is connected to a CCR 200 which forms the input resistor to operational amplifier 202, which together form expander/compressor 66 exactly as for expander/compressor 64. Again therefore, the compression ratio achieved by expander/compressor 66 can be adjusted between the extremes of 1:1 and 4:1, independently of the other expander/compressor block 64. Since the CCRs controlled by the variable resistors CRH and CRL have relatively high input impedance, the setting of the wiper of one variable resistor has little effect on the setting achieved by the other. Resistors CRH and CRL may be implemented mechanically or electronically.

Figure 9A:
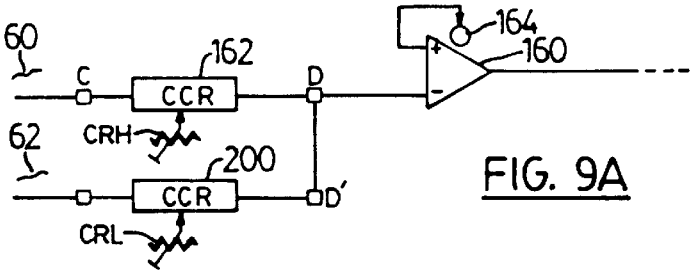
FIG. 9A is a block diagram showing a modification of the FIG. 9 block diagram.

While operational amplifier inverters 160 and 202 and summing junctions 68 have been shown as separate blocks, they are preferably implemented as a single inverting operational amplifier which performs the summation function and also adds some additional gain. This is accomplished by using CCR's 162, 200 as source or input resistors, i.e. the two nodes D and $D^1$ (FIG. 9) are connected together and to the inverting node of the summation operational amplifier (e.g. amplifier 160), making amplifier 202 and separate summer 68 unnecessary. This is shown in FIG. 9A. Amplifier 160 with its two CCR's now functions as the two expander/compressors 64, 66 and as the summer 68.

The inflection points 54, 56 (FIG. 3B) will now be discussed, with reference to FIGS. 14A, 14B and 14C, which show input versus output curves for the entire circuit of FIGS. 2 and 4. It will be seen that because the control signals for the expander/compressors 64, 66 are derived from the same control circuit 74 which controls compressor 36, the expander/compressors 64, 66 inherit the same inflection points 54, 56 found in the input/output curves (FIG. 3B) for compressor 36. These inflection points for the complete system input vs. output curves are shown at 54', 56' in FIGS. 14A to 14C and are adjustable.

The lower inflection point 54' can be adjusted by adjusting potentiometer TK (FIG. 4) which adjusts the value of current $I_{TH2}$ produced by current source 130. The manner in which potentiometer TK adjusts $I_{TH2}$ is well known to those skilled in the art (potentiometer TK corresponds to resistor 63 in FIGS. 4(*a*) and 4(*b*) of said prior applications) and therefore need not be explained in detail.

The upper inflection point 56' is the point at which the voltage at the base of transistor $Q_{207}$ (FIGS. 10 and 11) does not change when resistor CRH is adjusted. In other words, the voltage at each end of resistor CRH should be the same. This is achieved by setting $I_{INFL}$ such that $V_{GAIN} = V_{INFL}$ at the desired inflection point. In this situation, there is no voltage drop across $R_{10}$, which is the input resistor of $Q_{206}$, so there is no voltage drop across feedback resistor $R_{11}$. Therefore $V_{GAIN}$, $V_{INFL}$ and $V_{EXP}$ are all the same, i.e. there is no voltage drop between terminals 82, 86 of the $$\frac{K}{\sqrt{X}}$$

block 84. Therefore, adjusting the wiper of resistor CRH at this output level will not change the gain of expander/compressor 64.

Figure 14A:
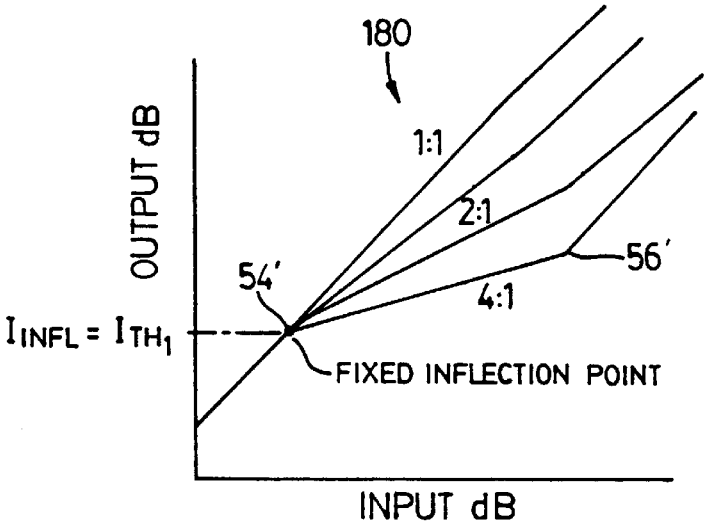
FIG. 14A, 14B and 14C are graphs showing system output versus input for various inflection points set by the circuit of FIGS. 2 and 4.

FIG. 14A shows the system behaviour when $I_{INFL}$ is set equal to the quiet signal level or lower threshold current, i.e. $I_{INFL}$ equals $I_{TH1}$. Since $V_{GAIN}$ equals $V_{INFL}$ at this threshold, a set of input/output curves is produced as indicated at 180 and are similar to those typically found in most hearing aid designs featuring variable compression ratio.

Figure 14B:
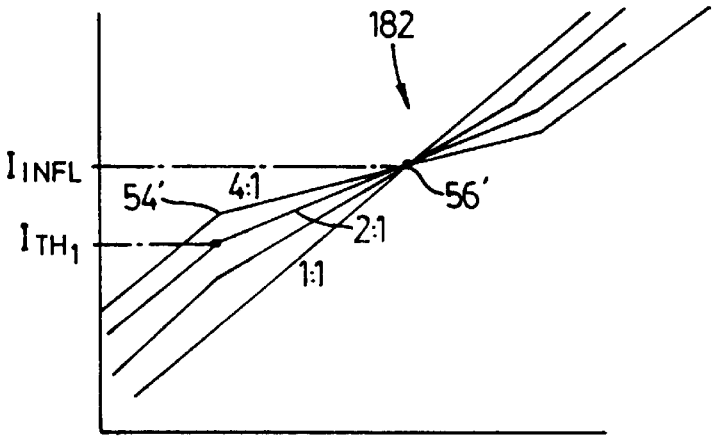

FIG. 14B shows the input/output curves 182 which result when $I_{INFL}$ is greater than $I_{TH1}$ but less than $I_{MAX}$. This set of input/output curves makes fitting a hearing aid difficult, since both low level gain and high level gain change simultaneously. This presents a practical problem for an audiologist since there are many interactions with which he/she must deal.

Figure 14C:
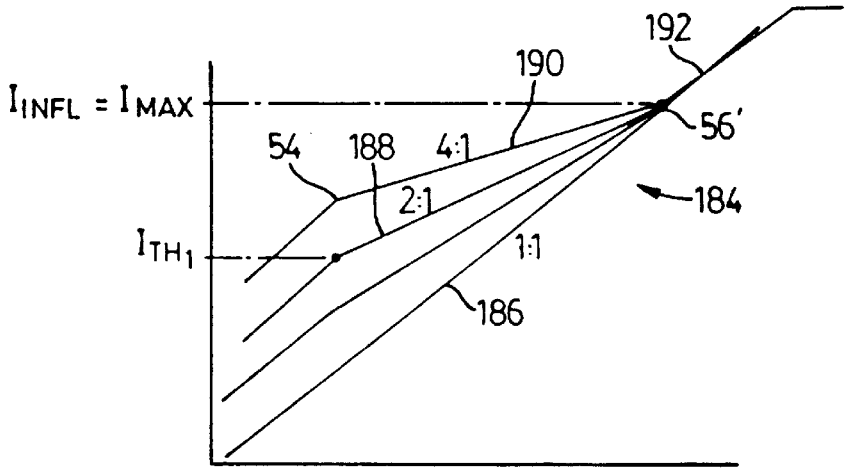

FIG. 14C shows input/output curves 184 which result when $I_{INFL}$ is set equal to $I_{MAX}$. With this setting, moving the wiper of resistors CRH or CRL when $I_{SLOW3}$ is above $I_{MAX}$ will not change the gains of expander/compressors 64, 66. Thus there is fixed gain for all signals below the lower threshold 54' and fixed gain for all signals above the upper threshold 56'. The gain given to sounds below threshold 54' or above threshold 56' is unaffected by changes in the compression ratio of expander/compressors 64/66. Therefore, as shown in FIG. 14C, the overall system compression ratio between the two thresholds can be 1:1 (curve 186), 2:1 (curve 188) or 4:1 (curve 190); in all cases, the system output 192 above the high level threshold 56' remains the same. This simplifies the application of the system to hearing loss compensation since it takes into account the phenomenon of normal loudness growth at high levels for most hearing impaired users. The audiologist may now use the freedom afforded by the variable compression ratio to adjust for various loudness growth rates of different users for quiet and moderate sounds and simultaneously to provide adequate amplification of quiet sound to ensure that they are audible.

It will be realized that different input/output curves may be provided for each frequency band, as required by the user, and that any required number of frequency bands may be employed.

While preferred embodiments of the invention have been described, it will be appreciated that various changes may be made within the scope of the invention, and such changes are intended to be within the scope of the appended claims.

We claim:

1. An audio circuit comprising:

(a) an input for receiving an electrical audio input signal, (b) a front compressor coupled to said input for compressing said input signal to produce a compressed signal, (c) a filter coupled to said front compressor for receiving said compressed signal and for dividing said compressed signal into at least two frequency band signals, each in a different frequency band, said filter having at least first and second outputs, one for each frequency band signal, (d) at least first and second expander/compressors, one coupled to each of said outputs of said filter, each for selectively expanding or compressing one of said frequency band signals, and for producing output signals, (f) a control signal generator for producing first and second control signals each dependent on the level of said input signal, (g) means coupling said first control signal to said front compressor and said second control signal to said expander/compressors, so that said front compressor and each said expander/compressor are all controlled by said control signal generator and so that each expander/compressor will selectively expand or compress the frequency band signal received by it depending on the control signal applied to it.

2. The circuit of claim 1 wherein said front compressor produces a fixed compression ratio.

3. The circuit of claim 2 wherein said compression ratio is 2:1.

4. The circuit of claim 2 wherein said control signal generator is coupled to an output of said front compressor for receiving said compressed signal therefrom, said control signals therefore each being dependent on the level of said compressed signal.

5. The circuit of claim 4 wherein said control signal generator includes means for controlling said front compressor to apply a first gain to input signals below a lower loudness threshold, and to compress input signals between said lower loudness threshold and an upper loudness threshold, and to apply a second and fixed gain to signals above said upper loudness threshold and below an upper limit, and means for causing said expander/compressors to apply a third fixed gain to signals above said upper loudness threshold.

6. The circuit of claim 1 and including a signal processor coupled between said control signal generator and each expander/compressor and having first and second outputs, said signal processor including means for processing said second control signal to produce at said first output a third control signal for causing one of said expander/compressors to expand an input signal applied thereto, and to produce at said second output a fourth control signal for causing said one of said expander/compressors to compress an input signal applied thereto, and means for selectively connecting one of said first and second outputs to each said expander/compressor.

7. The circuit of claim 6 wherein said means for selectively connecting comprises a variable resistance connected between said first and second outputs for providing a fifth control signal which is variable continuously between said third and fourth control signals, thus for enabling continuous adjustment of each said expander/compressor between compression and expansion.

8. The circuit of claim 7 wherein said front compressor provides a 2:1 compression ratio, and said signal processor and said expander/compressors include means for controlling each expander/compressor between 1:2 expansion and 2:1 compression, thereby allowing overall adjustment of the compression of said input signal between 1:1 and 4:1.

9. The circuit of claim 6 wherein said fourth control signal is proportional to the inverse of the square root of said first control signal.

10. The circuit of claim 7 or 8 wherein said fifth control signal is proportional to the inverse of the square root of said first control signal.

11. The circuit of claim 1 wherein said front compressor includes an amplifier having a negative feedback loop, and a controllable resistance in said loop, said first control signal being applied to said controllable resistance.

12. The circuit of claim 11 wherein each expander/compressor includes an amplifier having an amplifier input, and a second controllable resistance connected in series between said amplifier input and said filter, so that said second controllable resistance acts as an input resistance to said amplifier, said second control signal being coupled to said second controllable resistance.

13. The circuit of claim 11 wherein said expander/compressors together comprise an amplifier having an amplifier input, and a plurality of further controllable resistances, each further controllable resistance being connected between said amplifier input and an output of said filter, so that said further controllable resistances act as input resistances to said amplifier, said second control signal being coupled to said further controllable resistances.

14. The circuit of claim 1, 5, 6, 7, 8, 12 or 13 and forming part of a hearing aid, said hearing aid having an input transducer for converting received sound into said audio input signal, and an output transducer coupled to said means for combining said output signals, for producing sound dependent on said output signals.

* * * * *